US011160339B2

(12) United States Patent
McKenzie et al.

(10) Patent No.: US 11,160,339 B2
(45) Date of Patent: Nov. 2, 2021

(54) LIGHT BLOCKING APPARATUS AND METHOD OF USING SAME

(71) Applicant: Knoll, Inc., East Greenville, PA (US)

(72) Inventors: James Harrison McKenzie, Perkasie, PA (US); Tracy Wymer, East Greenville, PA (US); Jeffrey Lee, East Greenville, PA (US); David Fisher, East Greenville, PA (US); James Eldon, Pennsburg, PA (US); David McClanahan, Pennsburg, PA (US)

(73) Assignee: Knoll, Inc., East Greenville, PA (US)

( * ) Notice: Subject to any disclaimer, the term of this patent is extended or adjusted under 35 U.S.C. 154(b) by 0 days.

(21) Appl. No.: 17/090,944

(22) Filed: Nov. 6, 2020

(65) Prior Publication Data

US 2021/0140604 A1 May 13, 2021

Related U.S. Application Data

(60) Provisional application No. 62/933,636, filed on Nov. 11, 2019.

(51) Int. Cl.
*A45B 23/00* (2006.01)

(52) U.S. Cl.
CPC ..... *A45B 23/00* (2013.01); *A45B 2023/0093* (2013.01)

(58) Field of Classification Search
CPC ..... A45B 23/00; A45B 2023/0093
See application file for complete search history.

(56) References Cited

U.S. PATENT DOCUMENTS 2,428,649 A * 10/1947 Brown ..... A61G 7/05 362/144
2,821,450 A 1/1958 Knoll
4,222,680 A * 9/1980 Browning ..... A45B 17/00 403/133
4,248,325 A 2/1981 Georgopoulos
4,325,597 A 4/1982 Morrison
5,000,210 A * 3/1991 Worthington, Jr. ..... A47C 7/66 135/90
5,287,909 A 2/1994 King et al.
5,641,191 A * 6/1997 Jia ..... B60J 3/02 16/224
5,675,946 A 10/1997 Verbeek et al.
5,680,893 A 10/1997 Neer
(Continued)

FOREIGN PATENT DOCUMENTS

CH 322095 A * 5/1957 ..... A45B 23/00
CH 456064 A * 5/1968 ..... A45B 23/00

*Primary Examiner* — Noah Chandler Hawk
(74) *Attorney, Agent, or Firm* — Buchanan Ingersoll & Rooney PC

(57) ABSTRACT

An apparatus and method can be configured to adjustably block natural light and/or overhead lighting to provide a use desired amount of light within a particular work space. Embodiments can help permit a user to adjust the light affecting that user's work space so a common lighting arrangement affecting many different work spaces' within a common area (e.g. an office floor or large office room within a building, etc.) so that the illumination provided by one or more light sources to illuminate the common area can be adjusted to meet a particular user's preferences within a particular work space within that common work area.

11 Claims, 11 Drawing Sheets

(56) References Cited

U.S. PATENT DOCUMENTS

| | | | | |
|---|---|---|---|---|
| 5,937,881 | A * | 8/1999 | Villa | A45B 23/00 135/20.1 |
| 5,966,879 | A | 10/1999 | Verbeek et al. | |
| 6,000,180 | A | 12/1999 | Goodman et al. | |
| 6,002,613 | A | 12/1999 | Cloud et al. | |
| D427,783 | S | 7/2000 | Luedke | |
| 6,202,659 | B1 * | 3/2001 | Sachs | A45B 17/00 135/142 |
| 6,293,292 | B1 * | 9/2001 | Watzke | A47C 7/66 135/123 |
| 6,367,213 | B1 | 4/2002 | Reuter et al. | |
| D457,359 | S | 5/2002 | Chan | |
| D458,040 | S | 6/2002 | Stannis et al. | |
| 6,405,742 | B1 * | 6/2002 | Driscoll | A45B 11/00 135/20.1 |
| 6,896,028 | B2 | 5/2005 | Brennan | |
| 7,310,918 | B1 | 12/2007 | Reuter et al. | |
| 7,789,025 | B2 | 9/2010 | Michaud, II et al. | |
| D653,862 | S | 2/2012 | Hairston | |
| 8,365,798 | B2 | 2/2013 | Feldpausch et al. | |
| 9,016,300 | B1 * | 4/2015 | Gillespie | A45B 19/04 135/139 |
| D796,216 | S | 9/2017 | Rockwell et al. | |
| D800,459 | S | 10/2017 | Rockwell et al. | |
| 9,920,520 | B2 | 3/2018 | Udagawa et al. | |
| 9,970,212 | B2 * | 5/2018 | Summers | A45B 23/00 |
| 10,030,407 | B1 * | 7/2018 | Beedle | A47G 5/00 |
| 2008/0142058 | A1 * | 6/2008 | Chan | A45B 23/00 135/20.1 |
| 2009/0139669 | A1 * | 6/2009 | Robin | A47C 7/66 160/351 |
| 2012/0304441 | A1 | 12/2012 | Henriott | |
| 2017/0226749 | A1 | 8/2017 | Fjetland | |
| 2019/0365101 | A1 | 12/2019 | Udagawa et al. | |

* cited by examiner

LIGHT BLOCKING APPARATUS AND METHOD OF USING SAME

CROSS-REFERENCE TO RELATED APPLICATIONS

The present application claims priority to U.S. Provisional Patent Application No. 62/933,636, filed on Nov. 11, 2019. The entirety of this provisional patent application is incorporated by reference herein.

FIELD

The present innovation is related to office furniture. In some embodiments, a device is configured for adjustable positioning near a work space within an office to allow a user to adjust the position of a shield to block natural light from a work surface (e.g. desktop or tabletop). Methods of making and using embodiments of these types of device are also provided herein.

BACKGROUND

Privacy screens and modesty screens can be utilized to provide a visible barrier in a workplace setting or other setting. Examples of privacy screens and/or modesty screens can be appreciated from U.S. Pat. Nos. 9,920,520, 8,365,798, 7,789,025, 7,310,918, 6,896,028, 6,367,213, 6,002,613, 6,000,180, 5,966,879, 5,675,946, 5,680,893, 5,287,909, 4,325,597, 4,248,325, and 2,821,450, U.S. Design Pat. Nos. D800,459, D796,216, D653,862, D458,040, D457,359, and D427,783 and U.S. Patent Application Publication Nos. 2017/0226749 and 2012/0304441.

In some workplace settings, office furniture and offices are structured to facilitate the illumination of work spaces via natural light passing through external windows (e.g. light from the sun passing through exterior windows and into internal office spaces or cubicles etc.). Such natural light can cause unanticipated problems that we have recognized. For example, natural light can cause glare or other problems associated with effective use of displays, computer monitors, tablet screens, smart phone screens, or other types of display devices (e.g. liquid crystal displays, etc.). Also, some workers may prefer a darker work space than others.

SUMMARY

We have determined that a new type of visible light shield is needed to address issues that we have recognized. Embodiments of our innovation can be utilized to help a worker within a work space have a preferred amount of lighting from a natural light source and/or overhead lighting that can affect a large number of office spaces (e.g. cubicle offices) within a particular common room or office floor. Methods of making and using embodiments of our device are also provided. These methods can be utilized to help a user adjust his or her work space lighting to meet his or her preferences even when that user is unable to control whether a light source is turned on or not, the amount of luminescence provided by one or more light sources, and/or other light related factors that can affect the user's work space (e.g. desktop or tabletop within a cubicle or work area at which the user is working within an office building, floor of an office building, or large room of an office building, etc.).

Embodiments of a light blocking apparatus can include a light blocking device having a screen, a light blocking device attachment mechanism, and an intermediate portion between the light blocking device attachment mechanism and the screen. The screen can include a body configured to block sunlight. The intermediate portion can include a telescoping member that is extendable and retractable. The screen can be attached to a first end of the telescoping member via a screen attachment mechanism. The light blocking device attachment mechanism can be attached to a second end of the telescoping member such that the intermediate portion is rotatable relative to the light blocking device attachment mechanism.

In some embodiments, the screen attachment mechanism can include a first swivel mechanism and a second swivel mechanism. The screen can be rotatable in a first rotational direction about a rotational axis defined by the first swivel mechanism and the screen can be rotatable in a second rotational direction about an axis of rotation defined by the second swivel mechanism. The rotational axis of the first swivel mechanism can be parallel to a length of the telescoping member and the rotational axis of the second swivel mechanism can be transverse or perpendicular to the length of the telescoping member (e.g. perpendicular or substantially perpendicular, such as within 10° of being perpendicular or within 5° of being perpendicular, etc.).

Some embodiments of the light blocking device attachment mechanism can be configured so that the light blocking device is slideable along a structure when attached to the structure. The light blocking device attachment mechanism can include a body having a first jaw and a second jaw spaced apart from the first jaw to define a mouth for receiving at least a portion of the structure. The first jaw can be moveable relative to the second jaw to adjust a size of the mouth.

In some embodiments, the light blocking device attachment mechanism can include a ball joint or an axle about which the second end the telescoping member is rotatable such that the intermediate portion is rotatable relative to the light blocking device attachment mechanism. The intermediate portion can be rotatable about a first rotational axis that can be parallel to a length of the telescoping member and a second rotational axis that can be transverse or perpendicular to the length of the telescoping member.

A method of adjusting illumination of a work space is also provided. Embodiments of the method can include positioning a light blocking device adjacent a first work space that is within a common work space having multiple other work spaces for different workers, adjusting a position of the light blocking device to block sunlight passing into the first work space via at least one external window of the common work space by at least one of:

(a) linearly extending or retracting a telescoping member of the light blocking device between a fully retracted position and a fully extended position, (b) rotating a screen of the light blocking device about the first axis of rotation of a screen attachment mechanism in a first rotational direction, the screen attachment mechanism attaching the screen to a first end of the telescoping member, (c) rotating the screen about a second axis of rotation of the screen attachment mechanism in a second rotational direction, (d) moving the light blocking device along a structure to which the light blocking device is attached via a light blocking device attachment mechanism, the structure being adjacent a work surface, the structure defining a path of the moving of the light blocking device via attachment of the structure to a slideable connection mechanism of the light blocking attachment mechanism, and (e) rotating the telescoping member relative to the light blocking device attachment mechanism about at least one rotational axis via a rotational attachment mechanism of the light blocking device attachment mechanism connecting a second end of the telescoping member to the light blocking device attachment mechanism.

In some embodiments, all of options (a)-(e) may be performed. In other embodiments, only one of these options, only two of these options, only three of these options, or only four of these options may be performed. In some embodiments, at least two, three or four of options (a)-(e) occur simultaneously. In yet other embodiments, all of options (a)-(e) (which can also be considered steps (a)-(e) or elements (a)-(e)) can occur simultaneously.

In some embodiments of the method, the light blocking device can have a screen, the light blocking device attachment mechanism, and an intermediate portion between the light blocking device attachment mechanism and the screen. The screen can include a body configured to block sunlight and the intermediate portion can include a retractable member or be a retractable member. In some embodiments, a telescoping member can be extendable and retractable via linear motion and the screen can be attached to the first end of the telescoping member via the screen attachment mechanism. The light blocking device attachment mechanism can be attached to the second end of the telescoping member such that the intermediate portion is rotatable relative to the light blocking device attachment mechanism.

In some embodiments, the screen can have at least one handle attached to a body of the screen. A user can grasp the one or more handles to manipulate the screen and adjust the position of the screen for blocking light.

Other details, objects, and advantages of the invention will become apparent as the following description of certain exemplary embodiments thereof and certain exemplary methods of practicing the same proceeds.

BRIEF DESCRIPTION OF THE DRAWINGS

Exemplary embodiments of privacy screen apparatuses and screen attachment apparatuses are shown in the accompanying drawings and certain exemplary methods of making and practicing the same are also illustrated therein. It should be appreciated that like reference numbers used in the drawings may identify like components.

DETAILED DESCRIPTION OF EXEMPLARY EMBODIMENTS

Figure 1:
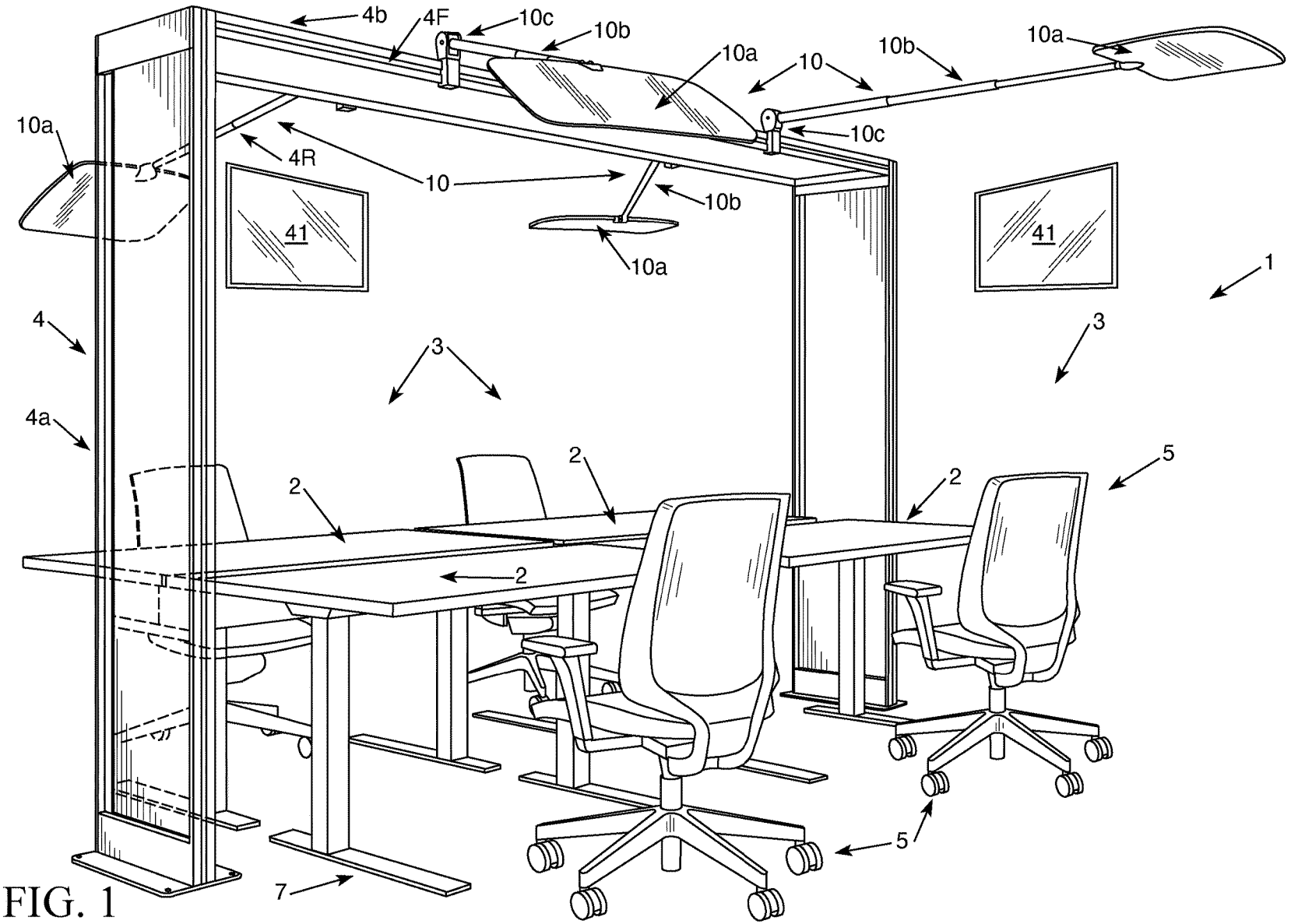
FIG. 1 is a perspective view of a first exemplary embodiment of a light blocking apparatus in a first positional arrangement configured to allow for illumination adjustment within multiple work spaces within a common work area.
Figure 2:
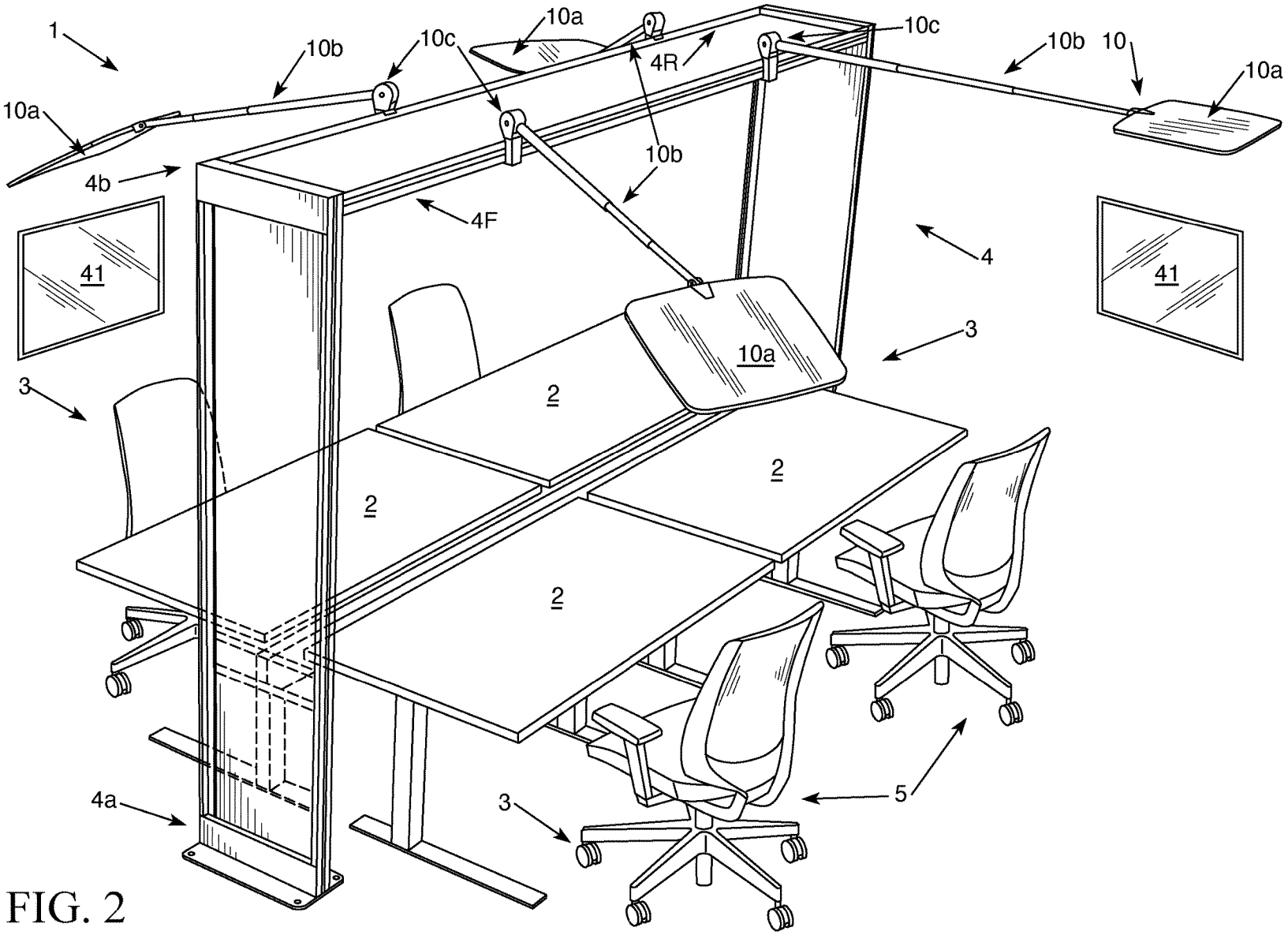
FIG. 2 is a perspective view of the first exemplary embodiment of the light blocking apparatus in a second positional arrangement configured to allow for illumination adjustment within multiple work spaces within a common work area.

Referring to FIGS. 1-14, a light blocking apparatus 1 can include one or more light blocking devices that are each independently adjustable by one or more users to affect how one or more work surfaces 2 are illuminated by natural light and/or overhead lighting affecting the different work areas 3 of different users within a common office building room or floor. The light blocking apparatus 1 can be incorporated into a common work space area that may have multiple tables or desks that each have at least one work surface 2. Each work surface 2 may be positioned for a respective worker within the common work space that has multiple different work areas 3. For instance, a common work space within a relatively large office floor or room can have at least four different work areas 3 that each have a respective work surface 2 for a respective worker assigned to that work area 3 (e.g. the common work space can include first, second, third and fourth work spaces for different work areas 3 of different workers, etc.). There may be multiple chairs 5 positioned in the common work space so that there is a respective chair 5 at each work area 3. The chairs 5 can be task chairs, side chairs, other types of chairs or combinations of such types of chairs.

Each work surface 2 can be a tabletop or desktop of a table 7 (e.g. height adjustable table or fixed height table, height adjustable desktop or fixed height desktop, etc.). In other embodiments, each work surface 2 can be a portion of a common tabletop or desktop at which multiple workers may work at in different discrete segments of the work surface 2.

It should be appreciated that some large rooms or floors can have a large common work space that has many different table and seating arrangements to define work areas 3 for many more workers (e.g. 25 workers, 50 workers, 100 workers, 200 workers, 1,000 workers, etc.) depending on the size of the floor or office room. There may therefore be longer and larger arrangements of tables 7 and work surfaces 3 to define many more work areas 3 than the exemplary four work areas illustrated in the exemplary embodiments illustrated in FIGS. 1-4 and 13.

There may be a partition 4 positioned adjacent to the different work surfaces 2 to help define different work areas 3 within a relatively large common room or floor of an office building in which many different work areas 3 can be positioned. Each partition 4 can include one or more vertically elongated segments 4*a* (e.g. partition walls etc.). There may also be one or more overhead, horizontally extending segments. Each horizontally extending segment 4*b* can be structured as overhead beams or rails that may facilitate positioning of different fixtures (e.g. privacy screens, lighting, etc.). Each horizontally extending segment 4*b* can be structured as a member that has a front side 4F and a back side 4R. The front and back sides 4F and 4R can extend between opposite ends of the member of the horizontally extending segment 4*b*. Each end of the member can be attached to an upper end of a respective vertically extending segment 4*a*. Each vertically extending segment can be structured as a partition wall, cubicle wall, screen, or other type of body that is configured to positioning on a floor of a common room or floor of a particular common work space in which many workers may work at their respective work areas 3.

In such common work spaces, there may be a ceiling that is positioned above the horizontally extending segments(s) 4*b*. There may be lighting positioned by, on or in such a ceiling that provides illumination for the entire common work space that affects multiple different workers' work areas 3 and work surfaces 2. There may also be externally positioned windows 41 that are positioned in walls of a building that permit natural sun light to pass into the common work space that can affect illumination of many of the different workers' work areas 3 and work surfaces 2 within the common work space. The natural light and its effect on the work areas 3 and work surfaces 2 can change over the course of the day as the sun's position in the sky. This condition also affects how the natural light from the sun passes through the windows 41 as well. Embodiments of our light blocking device 10 can be positioned adjacent the work surfaces 2 so that different users can adjust how the overhead light and natural light affect illumination of their particular work surface 2 and work area 3 to meet their illumination preference. Each light blocking device 10 can be independently moveable so each worker can adjust one or more light blocking devices 10 to affect how their particular work surface 2 and work area 3 is illuminated.

Each light blocking device 10 can include a proximate end 10*c* that is configured for attachment to a structure to allow the device to be positioned adjacent a work surface 2 and/or work area 3. The light blocking device 10 can also include a distal end at which a screen 10*a* is attached. The screen 10*a* can be opaque or at least partially opaque for blocking the transmission of sunlight, natural light, and/or visible light. For instance, the screen 10*a* can be configured as a body that blocks visible light (e.g. natural sunlight) from passing through the body of the screen 10*a*. It should be appreciated that the proximal end could be considered a first end and the distal end could be considered a second end or vice versa, e.g. the distal end could be considered a first end and the proximal end could be considered a second end or vice versa.

The light blocking device 10 can also include an intermediate portion 10*b* that can extend between its first end 10*e* and its second end 10*p*. The intermediate portion 10*b* can be a telescoping member that is retractable and extendable between an extended length EL and a retracted length RL. The telescoping motion of the intermediate portion may extend linearly in an extendible direction and a retractable direction that is opposite the extendible direction. An example of this extendible direction of motion and retractable direction of motion as indicated by arrow EandR shown in FIG. 14 and can also be appreciated from FIGS. 6-8 and 11-12, for example. The extended length EL may be the longest length of the intermediate portion when the intermediate portion 10*b* is fully extended and the retracted length RL can be its shortest length when the intermediate portion is fully retracted. It should be appreciated that there may be one or more segments of the intermediate portion that are telescopingly attached to other segments to permit the intermediate portion to be linearly extended and retracted to different positions between its extended length EL and retracted length RL.

For example, the intermediate portion 10*b* can be or include a telescoping member. The telescoping member of the intermediate portion 10*b* can include multiple interconnected telescoping segments $\mathbf{10}b_1$, $\mathbf{10}b_2$ (these segments can be considered a first segment and a second segment). In some embodiments, these segments can be tubular segments (e.g. cylindrical, pipe-like, rectangular, or polygonal cross-section shaped segments having inner channels). Each segment can be attached to another segment via at least one telescoping connection 10*t*. For instance, a first segment $\mathbf{10}b_1$ can be telescopingly connected to a first end of a second segment $\mathbf{10}b_2$.

In some embodiments, each segment can also be pivotally attached to the one or more other segments to which that segment is attached (e.g. the second segment can be pivotally connected to the first segment at its first end and pivotally connected to the third segment at its second end, etc.). Such pivotal motion can allow each segment to be rotated relative to other segments. This rotatable connection between segments can be provided in addition to or as an alternative to the telescoping connections 10*t*.

In some embodiments, there may be more than two segments. For example, in some embodiments, the second end of the second segment $\mathbf{10}b_2$ can be telescopingly connected via a second telescoping connection 10*t* to a third segment $\mathbf{10}b_3$.

Each telescoping connection 10*t* of the telescoping member can permit a segment of the telescoping member to move relative to another segment. For instance, the second segment 10$b_2$ can linearly move away from or toward the first segment 10$b_1$ via the first telescoping connection 10*t*. Such motion can result in the second segment 10$b_2$ extending out of or further within an inner channel of the first segment 10$b_1$ or slide along an outer perimeter of the first segment 10$b_1$. As another example, a third segment 10$b_3$ can linearly move away from or toward the second segment 10$b_2$ via the second telescoping connection 10*t*. Such motion can result in the third segment 10$b_3$ extending out of or further within an inner channel of the second segment 10$b_2$ or sliding along an outer perimeter of the second segment 10$b_2$. The telescoping connections 10*t* can permit the telescoping member of the intermediate portion 10*b* to have the length to which the member extends adjusted for positioning the screen 10*a* at multiple different positions between the telescoping member's extended length EL and its retracted length RL.

Figure 13:
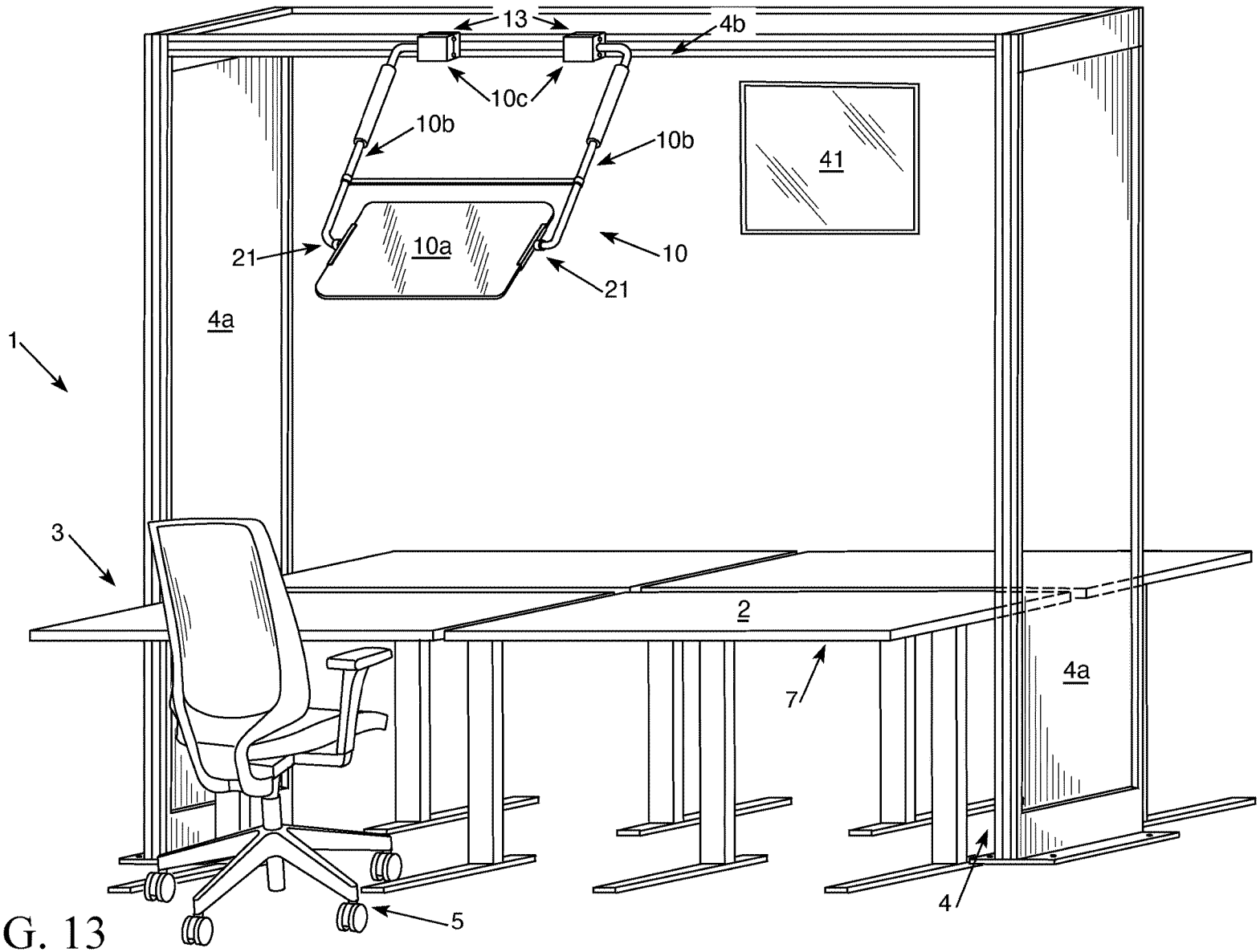
FIG. 13 is a schematic view of a third exemplary embodiment of a light blocking apparatus. It should be appreciated that the exemplary embodiment illustrated in FIG. 13 illustrates an exemplary embodiment of a light blocking device included in the apparatus that can also (or alternatively) be utilized in the first exemplary embodiment of the light blocking apparatus and/or the second exemplary embodiment of the light blocking apparatus.
Figure 14:
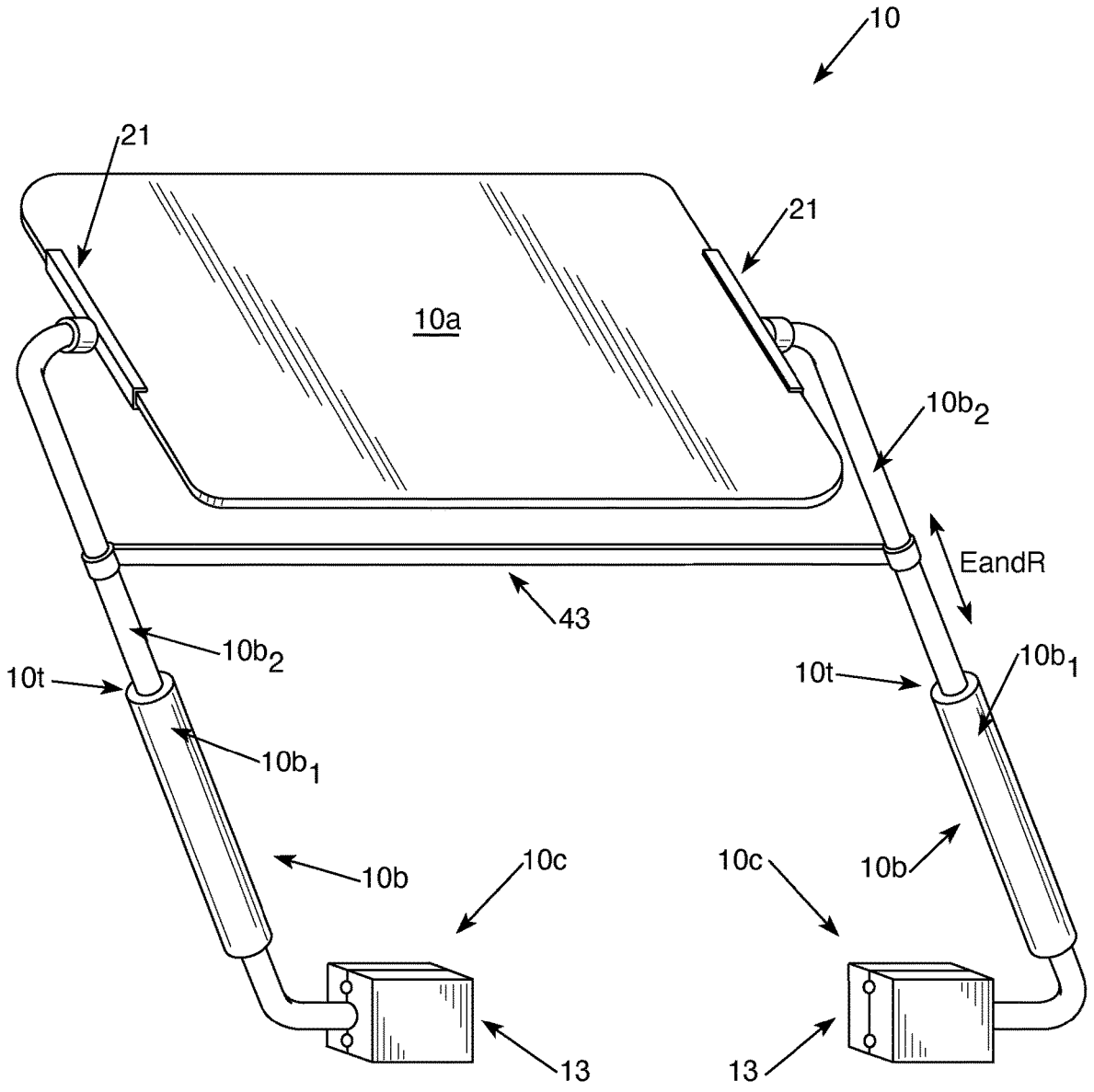
FIG. 14 is a schematic view of the exemplary embodiment of the light blocking device 10 of the third exemplary embodiment of the light blocking apparatus illustrated in FIG. 13.

In other embodiments such as the embodiment of the light blocking device 10 shown in FIGS. 13 and 14, there may be multiple telescoping members of multiple intermediate portions 10*b* that are spaced apart from each other. At least one cross-beam 43 can extend between segments of the spaced apart telescoping members (e.g. spaced apart second segments 10$b_2$) to provide improved rigidity or support for the device. Each intermediate portion 10*b* can include or be such a telescoping member that can have a second end (e.g. a proximal end) attached to a light blocking device attachment mechanism 13 and a first end (e.g. distal end) attached to a body of a screen 10*a* via a screen attachment mechanism 21. The screen attachment mechanism 21 can provide an affixed connection or a pivotal connection to the screen 10*a* such that the screen is rotatable about at least one axis of rotation (e.g. a horizontally extending axis of rotation) via the screen attachment mechanisms 21 connecting the spaced apart intermediate portions 10*b* to the screen 10*a* at opposite sides of the screen 10*a*. The light blocking device attachment mechanism 13 can affix the light blocking device 10 to a structure adjacent a work surface 2 of a work area 3 or can be slideably attached to the structure via a slideable attachment mechanism that can be sized and configured to permit the light blocking device to be moved along a path of motion defined by the structure to which the light blocking device attachment mechanism 13 is attached. Each of the second ends of the telescoping members can be connected to a respective light blocking device attachment mechanism 13 so that the telescoping members are pivotable or rotatable relative to the light blocking device attachment mechanism 13 to which it is attached via a horizontally extending axis of rotation and/or a vertically extending axis of rotation.

Figure 3:
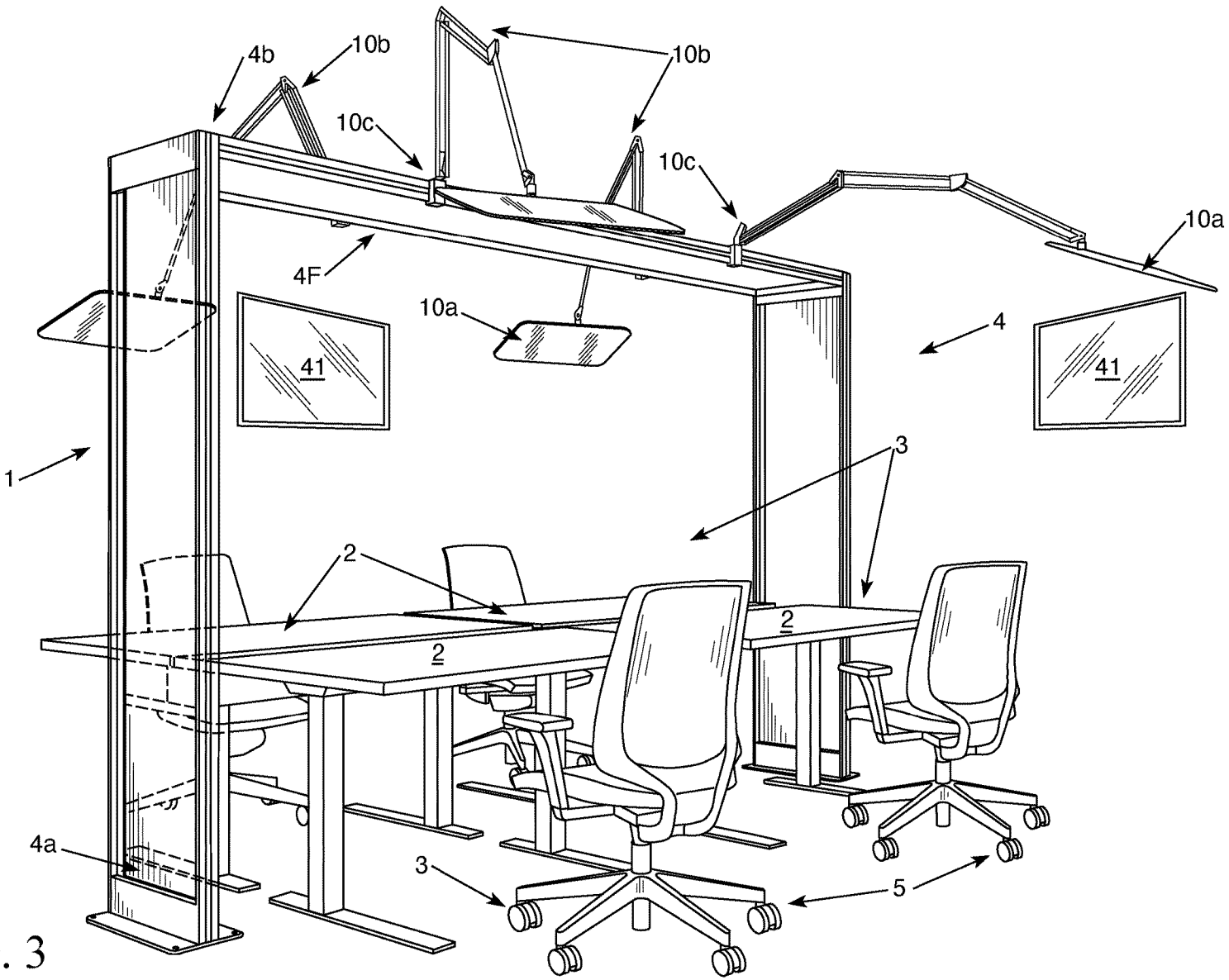
FIG. 3 is a perspective view of a second exemplary embodiment of a light blocking apparatus in a first positional arrangement configured to allow for illumination adjustment within multiple work spaces within a common work area.
Figure 4:
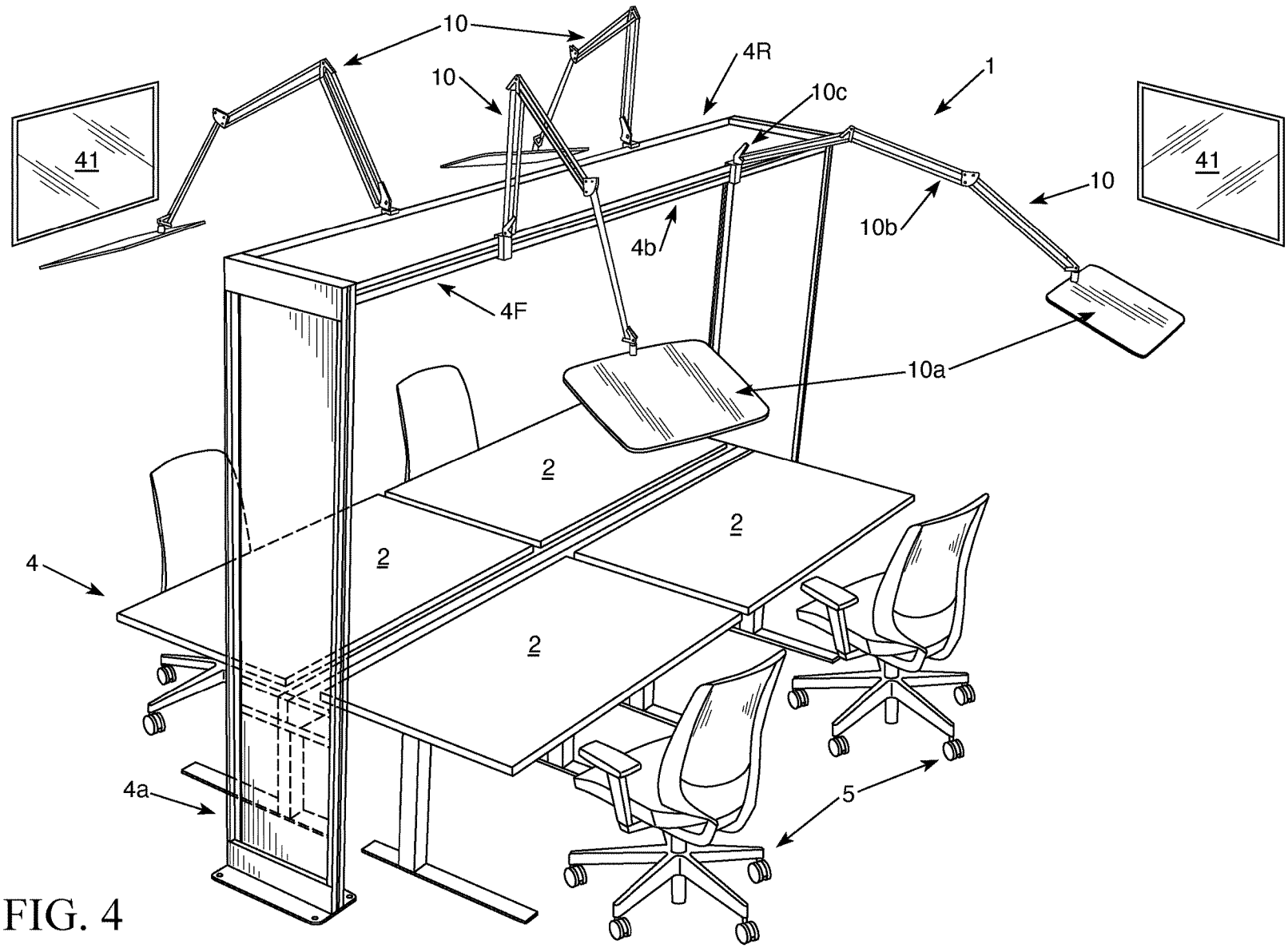
FIG. 4 is a perspective view of the second exemplary embodiment of the light blocking apparatus in a second positional arrangement configured to allow for illumination adjustment within multiple work spaces within a common work area.
Figure 5:
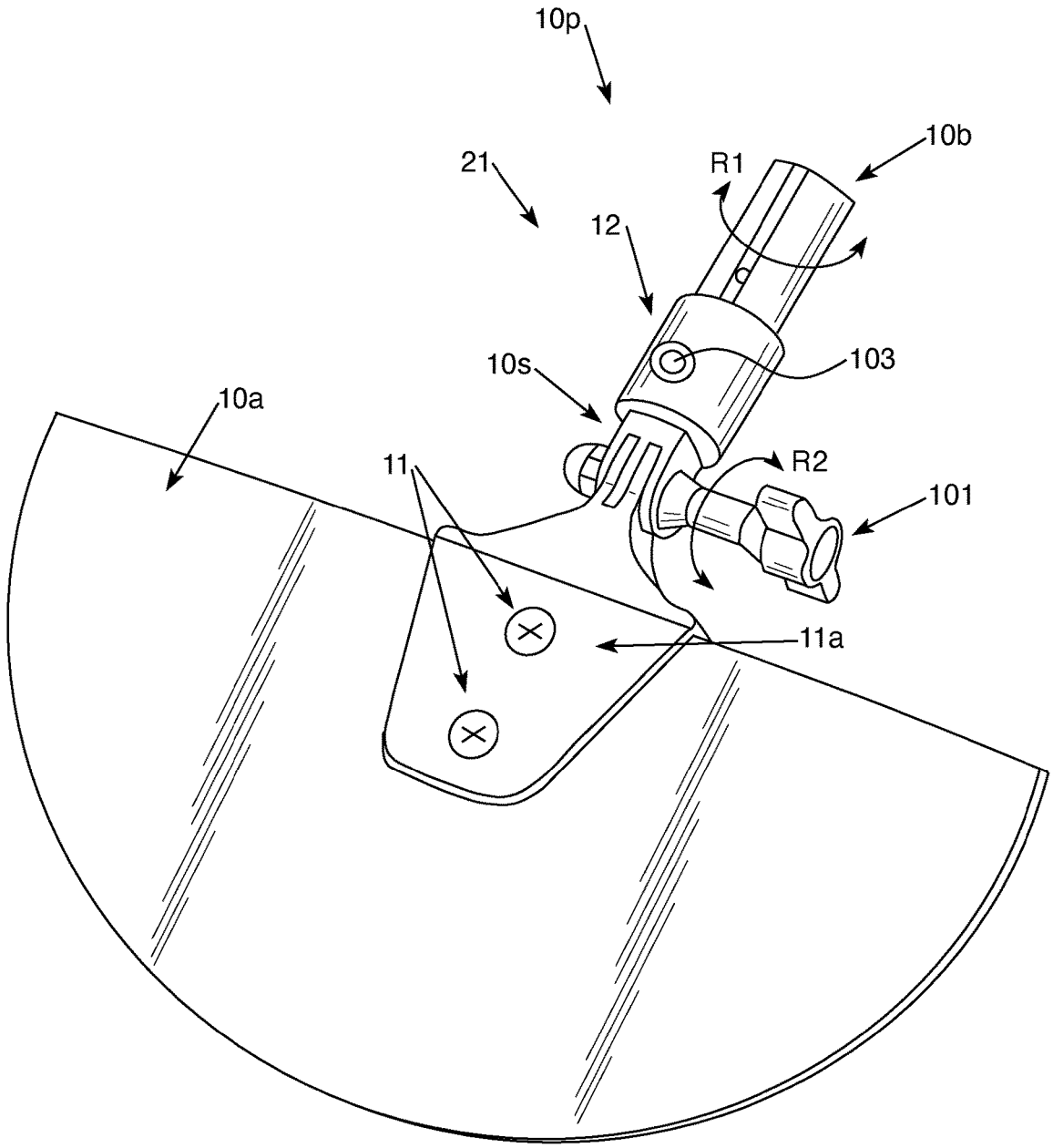
FIG. 5 is a fragmentary view of an exemplary embodiment of a screen that can be utilized in the first and second exemplary embodiments of the light blocking apparatus.
Figure 6:
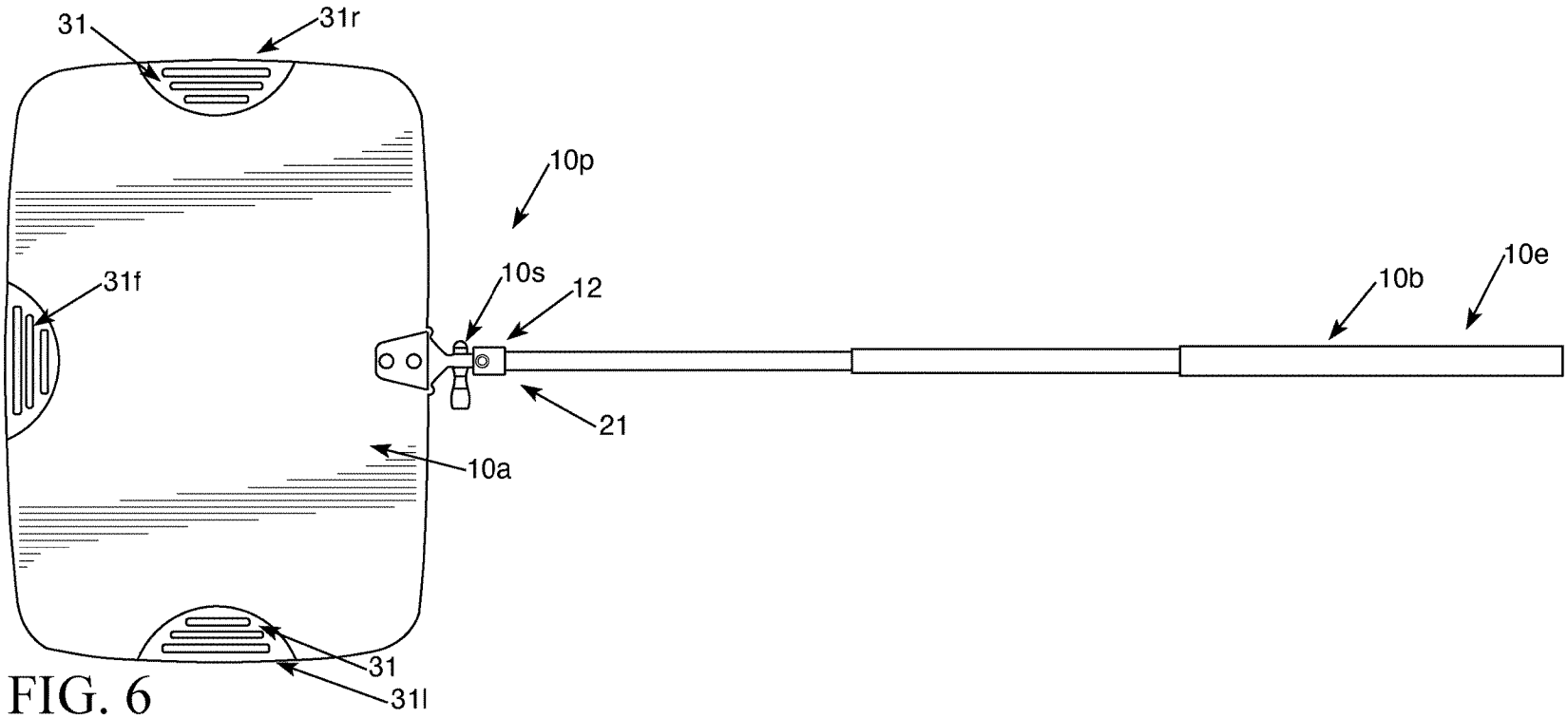
FIG. 6 is a top view of an exemplary embodiment of the adjustable light blocking device of the first exemplary embodiment of the light blocking apparatus.
Figure 7:
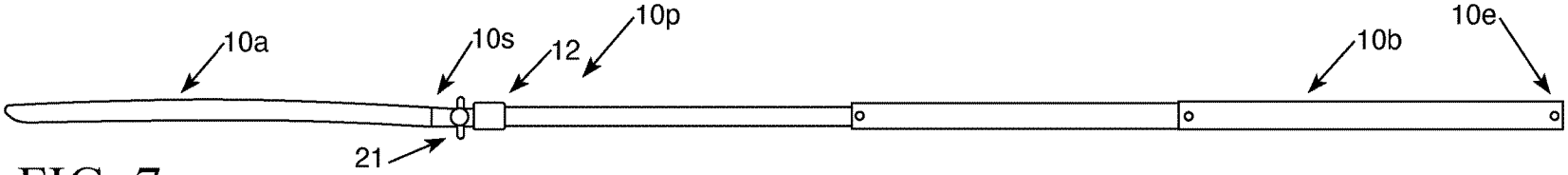
FIG. 7 is a side view of the exemplary embodiment of the adjustable light blocking device of the first exemplary embodiment of the light blocking apparatus.
Figure 8:
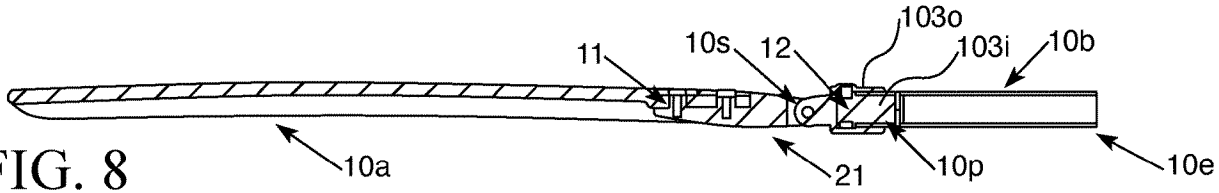
FIG. 8 is a cross-sectional view taken along line A-A illustrated in FIG. 6. This cross-sectional view illustrates the exemplary embodiment of the adjustable light blocking device of the first exemplary embodiment of the light blocking apparatus.
Figure 9:
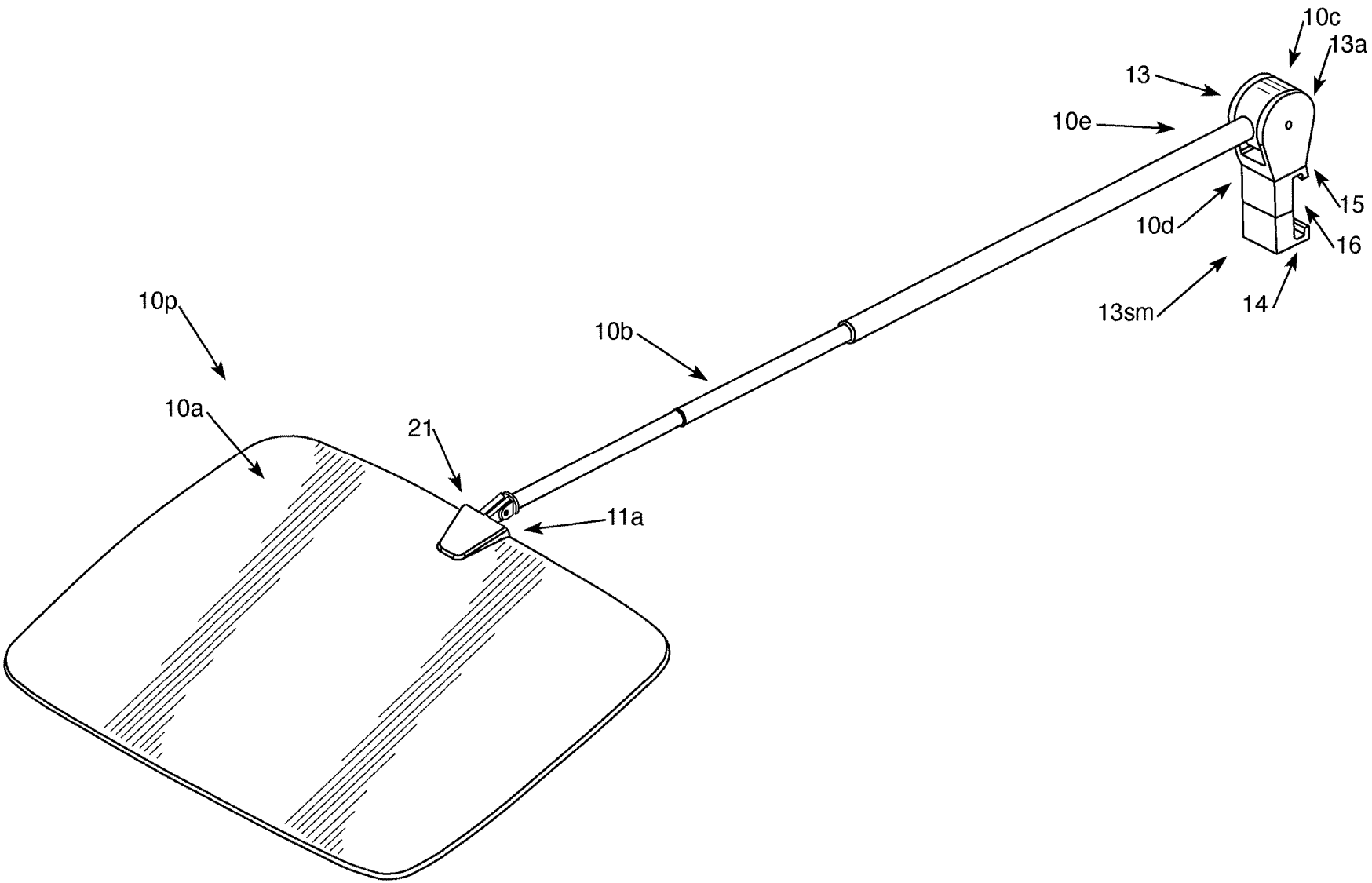
FIG. 9 is a perspective view of the exemplary embodiment of the adjustable light blocking device of the first exemplary embodiment of the light blocking apparatus.
Figure 10:
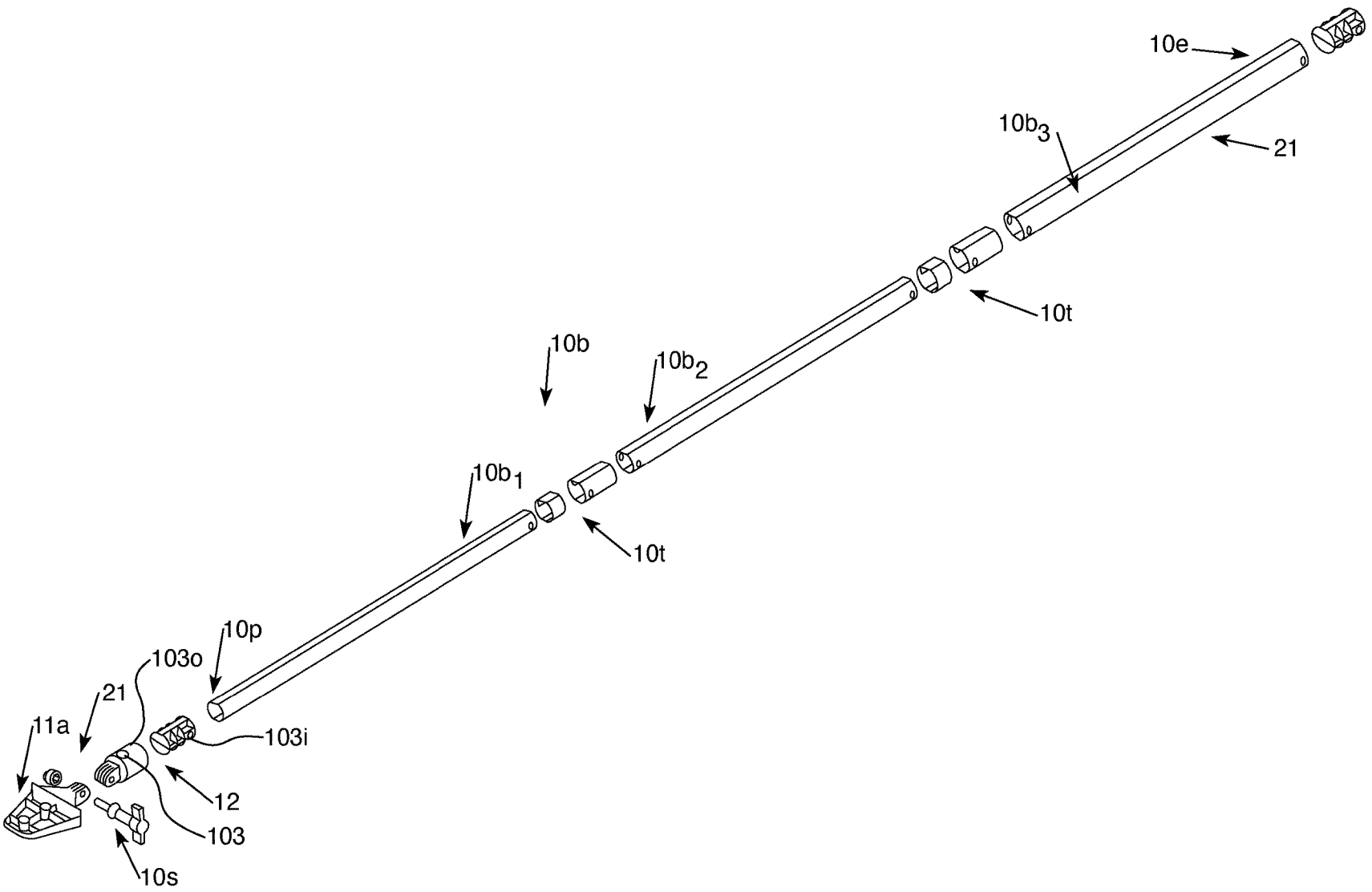
FIG. 10 is an exploded view of the exemplary embodiment of the adjustable light blocking device of the first exemplary embodiment of the light blocking apparatus with the screen 10*a* removed and the light blocking device attachment mechanism 13 removed.
Figure 11:
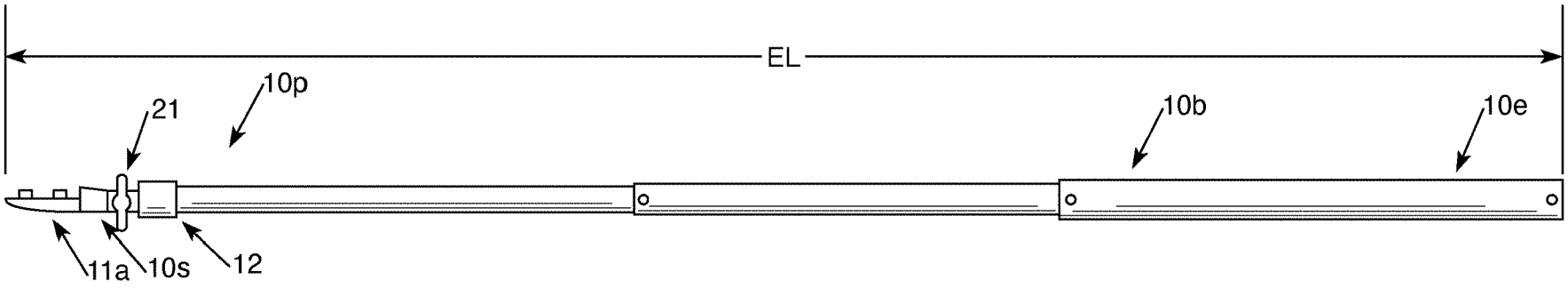
FIG. 11 is a side view of the exemplary embodiment of the adjustable light blocking device of the first exemplary embodiment of the light blocking apparatus in an extended position. It should be appreciated that the drawing of FIG. 11 illustrates the embodiment with the screen 10*a* removed and the light blocking device attachment mechanism 13 removed.
Figure 12:
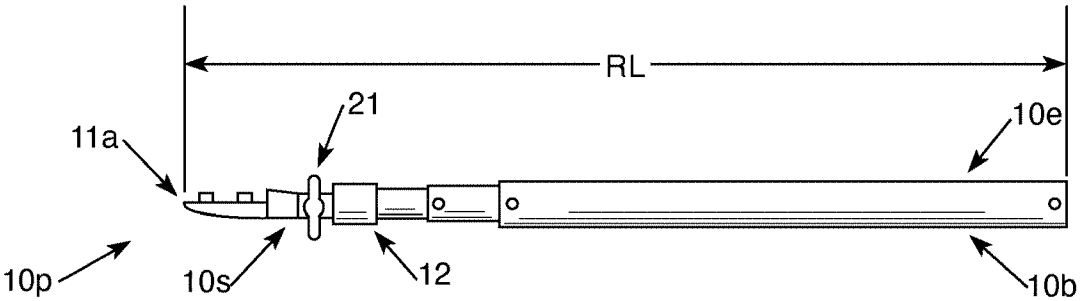
FIG. 12 is a side view of the exemplary embodiment of the adjustable light blocking device of the first exemplary embodiment of the light blocking apparatus in a retracted position. It should be understood that the drawing of FIG. 12 illustrates the embodiment with the screen 10*a* removed and the light blocking device attachment mechanism 13 removed.

In yet other embodiments, the intermediate portion 10*b* can be configured as an arm having a plurality of rotationally connected segments to permit motion of the intermediate portion to occur between an extended position and a retracted position as may be appreciated from the light blocking device embodiments shown in FIGS. 3 and 4. Such intermediate portions 10*b* can include multiple arm segments that are each rotatable relative to at least one other arm segment via a horizontally extending axle attached to the immediately adjacent arm segment of the intermediate portion 10*b*. In the embodiment shown in FIGS. 3 and 4, the intermediate portion 10*b* includes three arm segments, a proximal segment, a distal segment, and an intermediate segments between the proximal and distal segments. Other embodiments could utilize only two arm segments or more than three arm segments.

The proximal end 10*c* of the light blocking device 10 can have a light blocking device attachment mechanism 13. The light blocking device attachment mechanism 13 can be configured to permit movement of the intermediate portion 10*b* relative to the structure to which the light blocking device attachment mechanism 13 is attachable so that the intermediate portion is moveable about at least one axis of rotation relative to that structure (e.g. partition, or horizontally extending partition segment 4*b* or vertically extending partition segment 4*a* or other structure, such as a work surface 2 or table 7, etc.). For instance, the light blocking device attachment mechanism 13 can include at least one pivotal or rotational attachment of the proximal end of the intermediate portion (e.g. via a ball joint type connection or other type of rotational and tilting connection) to permit the intermediate portion 10*b* to be tilted and/or rotated about a vertical axis as well as a horizontal axis. As another example, the light blocking device attachment mechanism 13 can include a rotational attachment via at least one axle (e.g. a horizontally extending axle, a vertically extending axle), or a connection utilizing both types of axles, etc.) to permit rotation of the intermediate portion 10*b* about the at least one axle. The light blocking device attachment mechanism 13 can also be configured so that the light blocking device 10 is moveable (e.g. slideable) along at least a portion of the structure to which it is attached (e.g. has a slideable connection to that structure). For instance, the light blocking device 10 can be linearly slideable leftwardly or rightwardly along a front side 4F or rear side 4R of the horizontally extending member 4*b* via the slideable connection the light blocking device attachment mechanism 13 can have with a member of the horizontally extending segment 4*b* (e.g. a rail member of that segment positioned to define at least a portion of the front side 4F or rear side 4R, etc.).

The distal end of the light blocking device 10 can have a screen attachment mechanism 21 that connects the screen 10*a* to the intermediate portion 10*b* so that the screen 10*a* is moveable about at least one axis of rotation relative to the intermediate portion 10*b*. In some embodiments, the screen attachment mechanism 21 can be configured to include a ball joint or can be configured to include multiple different rotational axes to facilitate rotational motion of the screen 10*a* along different axes (e.g. tilting about a horizontal axis that is transverse or perpendicular to the length of the intermediate portion 10*b* while also permitting rotational motion about a linearly extending axis defined by the intermediate portion 10*b*, etc.).

Some embodiments of the screen attachment mechanism 21 and light blocking device attachment mechanism 13 can be further appreciated from FIGS. 5-14. For example, the second end 10*p* (e.g. a distal end) of the intermediate portion 10*b* of the light blocking device 10 can include an embodiment of a screen attachment mechanism 21 that utilizes a first swivel mechanism 12 to permit rotational motion of the screen 10*a* about an axis that extends along the length of the intermediate portion so that the screen is rotatable about a first rotational direction R1. The screen attachment mechanism 21 can also have a second swivel mechanism 10*s* that is configured to permit swiveling, or tilting, of the screen 10*a* about a linearly extending axle for rotational motion about a screen swivel rotational direction R2 (which can also be referred to as a second rotational direction). The axle of the second swivel mechanism 10*s* can extend in a direction that is transverse or perpendicular to the length of the intermediate portion 10*b*. The axle of the first swivel mechanism 12 can be defined so that the axis of rotation for the first swivel mechanism 12 extends in a direction that is aligned with and/or parallel to the length of the intermediate portion 10*b*.

The first swivel mechanism 12 and the second swivel mechanism 10*s* can each include a swivel lock or swiveling force adjustment mechanism. For instance, the first swivel mechanism 12 can include a set screw 103 extending between inner and outer tubular elements 103*i* and 103*o* positioned at the second end 10*p* of the intermediate portion 10*b*. The set screw 103 can be a bolt or screw that can be manipulated into tighter engagement or looser engagement with the inner tubular element to adjust an amount of force needed for rotation in a first rotational direction R1. The outer tubular element can be positioned to rotate relative to the inner tubular element so that the screen attached to the outer tubular element is rotatable when the outer tubular element rotates.

The set screw 103 can extend from the outer tubular element 103*o* to the inner tubular element 103*i* and be moveable to adjust its position and contact with the inner tubular element to adjust a force needed to rotate the screen 10*a* in the first rotational direction R1. For instance, the set screw can be rotated to further engage an inner tubular element 103*i* to more affixedly attach the outer tubular element 103*o* to the inner tubular element 103*i* to make rotation of the screen (via rotation of the outer tubular element 103*o* relative to the inner tubular element 103*i*) in the first rotational direction R1 require more force and can also be rotated in a second direction to lessen engagement with the inner tubular element so that less force is needed to rotate the screen (via rotation of the outer tubular element 103*o* relative to the inner tubular element 103*i*) in the first rotational direction R1. The increase in force provided by the set screw can be due, at least in part, to an increase in friction caused by the tighter engagement of the set screw and the decrease in force provided by the set screw can be due, at least in part, to an decrease in friction caused by the loosening of the engagement of the set screw.

The second swivel mechanism 10*s* can also include a lock 101 or other type of mechanism that is actuatable to adjust the amount of force needed to permit rotation of the screen 10*a* in the second rotational direction R2 about a second rotational axis. In some embodiments, the lock 101 can include a rotatable thumb screw or other rotatable element that is positioned to adjust the lock from a locked position to an unlocked position. The locked position can prevent rotational motion of the screen 10*a* about the axle of the second swivel mechanism 10*s* or can prevent rotational motion of the screen 10*a* in the second rotational direction R2 about the axle of the second swivel mechanism 10*s*, which can extend along its length in a direction that is transverse or perpendicular to the length of the inner and outer tubular elements of the first swivel mechanism 12. The one or more unlocked positions can include multiple unlocked positions that permit rotational motion of the screen 10*a* about the axle of the second swivel mechanism 10*s* or just a single unlocked position that permits such rotational motion.

The screen attachment mechanism 21 can also include one or more fasteners 11 (e.g. bolts, nails, rivets, or screws) that are configured to be passed through a portion of the screen 10*a* for attaching the screen 10*a* to a distal attachment body 11*a* attached to the second end 10*p* of the intermediate portion 10*b* of the light blocking device 10. The distal attachment body 11*a* can be attached to the first and second swivel mechanisms 12 and 10*s* for the rotational adjustability of the screen 10*a* via axes defined by axles or rotational axes of the swivel mechanisms 12 and 10*s*.

In other embodiments, it is contemplated that the distal attachment body 11*a* can be configured to matingly interlock with and/or resiliently retain a portion of the screen 10*a* so that a fastenerless attachment of the screen 10*a* to the intermediate portion 10*b* can be provided so that use of a mechanical tool (e.g. a screw driver, ratchet, or wrench) is not necessary. For instance, a side of the screen 10*a* can be sufficiently thick to be inserted within a mouth of a jaw of the distal attachment body 11*a* so that the jaw of the distal attachment body 11*a* contacts the screen 10*a* on its top and bottom faces to grip and retain the screen 10*a* therein via the resiliency of the jaws and the difference in thickness between the mouth of the jaws and the thickness of the screen 10*a*.

As may best be appreciated from FIG. 1-4 or 9, the light blocking device attachment mechanism 13 can be attached to the first end 10*e* (e.g. a proximal end) of the intermediate portion 10*b* at a proximal end 10*c* of the light blocking device 10. The light blocking device attachment mechanism 13 can include a rotational attachment mechanism 13*a* that permits the intermediate portion to be rotated via a ball-joint or via a linearly extending axle (e.g. a horizontally extending axle to permit rotational motion about that axle). The light blocking device attachment mechanism 13 can also include a structure attachment mechanism for attachment to a structure for positioning the light blocking device 10 adjacent a work surface 2 and/or work area 3. The structural attachment mechanism can include a bracket. One or more fasteners (e.g. bolts, screws, etc.) can be used in conjunction with the bracket for attaching the light blocking device attachment mechanism 13 to a structure (e.g. horizontally extending segment 4*b* or vertically extending segment 4*b* or work surface 2 or table 7 etc.).

The structural attachment mechanism of the light blocking device attachment mechanism 13 could alternatively (or also) include a slideable attachment mechanism 13*sm*. For instance, the light blocking device attachment mechanism 13 can include an upper jaw 15 and a lower jaw 14 that are spaced apart to define a mouth 16 for receiving a rail or other structure for attachment to that rail or other structure so that the light blocking device attachment mechanism 13 is slideable along a path defined by the rail or other structure (e.g. a linearly extending path, a curved path, etc.).

The jaws 14 and 15 can extend from a lower portion 10*d* of the body of the light blocking device attachment mechanism 13. The lower portion 10*d* can be positioned below the rotational attachment mechanism 13*a* or include a body that extends below the rotational attachment mechanism 13*a*. In some embodiments, the jaws 14 and 15 can be moveably attached to the body of the lower portion 10*d* so that the spacing of the mouth 16 can be adjustable to facilitate attachment and disconnection from a structure and/or to adjust the amount of force that needs to be exerted to slide the light blocking device attachment mechanism 13 along a rail or other structure to which it is attached (e.g. making the mouth 16 smaller by moving the jaws 14 and 15 into a tighter engagement with the structure to increase the friction induced via sliding so that a greater amount of force is needed to actuate sliding, making the mouth 16 larger via moving the jaws 14 and 15 into a looser engagement with the structure to decrease the friction induced via sliding so that a lesser amount of force is needed to actuate sliding, moving the jaws to make the mouth larger so the light blocking device 10 can be decoupled from the structure, etc.).

The screen 10*a* can be configured to have one or more handles 31 that help permit a user to grab hold of a portion of the screen 10*a* for adjusting a position of the screen 10*a* and/or light blocking device 10. There may be a handle 31 at multiple different sides of the screen 10*a*. For instance, there may be front handle 31*f*, a left side handle 311 and a right side handle 31*r* at different sides of the screen 10*a*. The handles can be positioned on one face of the screen 10*a* or on two opposed faces of the screen 10*a* (e.g. top and bottom faces of the screen). The handles 31 can be structured as a more rigid element attached to the body of the screen 10*a* and include a profile to make it easier for a user to grab and manipulate the screen 10*a*. In other embodiments, the screen 10*a* may not have any handles 31 and a user may just directly contact the screen 10*a* with his or her hand to manipulate the screen 10*a* for adjustment of the position of the screen 10*a* and/or intermediate portion 10*b* (e.g. rotate screen 10*a* while also retract or extend intermediate section 10*b* or actuating one or both of these actions while also sliding the intermediate portion 10*b* and screen 10*a* along the front side 4F or rear side 4R of a horizontally extending segment 4*b* via the light blocking device attachment mechanism 13, etc.).

In an apparatus 1, the light blocking devices 10 can be attached to at least one structure adjacent work surfaces 2 and/or work areas 3 for movement of the screens 10*a* to user desired positions to block natural light or a portion of natural light at a desired location on the work surface. Such positioning can be adjusted throughout the day as the level of natural light and the focal point of the natural light affecting the worker changes due to the positioning of the sun in the sky relative to different external windows 41 through which the sunlight passes into the work areas 3 and/or work surfaces 2. The light blocking devices 10 can also be moved to block overhead lighting that may be present as desired by a user in a similar fashion. Such adjustment can occur by a user manipulating the intermediate portion 10*b* or the screen 10*a* to rotate and otherwise move the screen 10*a*. Example of this adjustability include performance of one or more of:

(a) linearly extending or retracting the intermediate portion 10*b* to one of many different positions between the fully retracted and fully extended positions (e.g. via directions EandR shown in FIG. 14, between extended and retracted lengths shown in FIGS. 11-12 or FIGS. 6-8, etc.);

(b) rotating the screen 10*a* about the first axis of rotation of the screen attachment mechanism 21 (e.g. first swivel mechanism 12, via a ball joint, etc.) in a first rotational direction (e.g. first rotational direction R1);

(c) rotating the screen 10*a* about the second axis of rotation (e.g. via second swivel mechanism 10*s*, via a ball joint, via outer tube element 103*o* rotating relative to inner tube element 103*i* at second end of intermediate portion 10*b*, etc.) in a second rotational direction (e.g. second rotational direction R2);

(d) moving (e.g. sliding, linearly sliding, etc.) the light blocking device 10 along the structure to which it is attached via the light blocking device attachment mechanism 13 about a path defined by that structure (e.g. a curved path or linearly extending path defined by a rail of the structure to which the light blocking device 10 is attached, etc.); and (e) rotating the intermediate portion 10*b* relative to the light blocking device attachment mechanism 13 about at least one rotational axis (e.g. linearly extending axle or ball joint, etc.) via the rotational attachment mechanism 13*a*.

These adjustment motions may all occur simultaneously or only some of these may occur simultaneously. In some embodiments, a user may make such adjustments discretely so that each motion occurs separately and independently of the other motions. In other embodiments, a user may be able to cause at least two of such motions to occur at the same time. In yet other embodiments, the light blocking devices 10 can be configured to permit all of such motions to occur at the same time if the user desires to provide the force needed to make such multiple adjustments simultaneously.

A user may also periodically readjust the position of at least one of the light blocking devices 10 at different times of the day to meet that user's preferences and needs. For instance, the light blocking device 10 can be repositioned to account for the focal point of light and the position of one or more displays the user is utilizing.

It should be understood that other modifications to the light blocking apparatuses, light blocking apparatus attachment mechanisms, and methods of making and using the same can be made to meet a particular set of design criteria. For example, it is contemplated that a particular feature described, either individually or as part of an embodiment, can be combined with other individually described features, or parts of other embodiments. The elements and acts of the various embodiments described herein can therefore be combined to provide further embodiments. As another example, the size, shape and weight of a screen body can be any size or shape to meet a particular set of design criteria. As yet another example, use of a covering and/or the extent to which a covering may cover an exterior surface of a screen can be adjusted as needed to meet particular design criteria and/or to provide a desired aesthetic effect (e.g. colored film to cover a body of the screen, no use of a covering, etc.). As yet another example, the type of mounting connector that is utilized in an embodiment of the light blocking apparatus may be any type of connector structure geometry that may facilitate use of a pre-selected fastening mechanism (e.g. bolts, screws, etc.) to meet a particular set of design criteria. As yet another example, the size and shape of the body of the screen for blocking light can be any of a number of shapes and sizes to meet a particular set of design criteria (e.g. the screen can be polygonally shaped, oval shaped, circular in shape, half-oval in shape, half-circular in shape, star shaped, hexagonally shaped, triangularly shaped, rectangular shaped, irregular shaped, shaped as a plate or disk, or have some other type of shape). The screen 10*a* can be composed of any of a number of suitable materials (e.g. felt, cork, wood, polymeric material, etc.). The intermediate portion 10*b* and other components of the light blocking device can also be made of any type of suitable material (e.g. metal, wood, plastic, polymeric material, combinations thereof, etc.).

Therefore, while certain exemplary embodiments of the light blocking apparatuses, light blocking devices, connection mechanisms for light blocking apparatuses and methods of making and using the same have been discussed and illustrated herein, it is to be distinctly understood that the invention is not limited thereto but may be otherwise variously embodied and practiced within the scope of the following claims.

What is claimed is:

1. A light blocking apparatus comprising:

a light blocking device having a screen, a light blocking device attachment mechanism, and an intermediate portion between the light blocking device attachment mechanism and the screen, the screen comprising a body configured to block sunlight;

the intermediate portion comprising a telescoping member that is extendable and retractable, the screen attached to a first end of the telescoping member via a screen attachment mechanism;

the light blocking device attachment mechanism attached to a second end of the telescoping member such that the intermediate portion is rotatable relative to the light blocking device attachment mechanism;

wherein the screen attachment mechanism comprises a first swivel mechanism and a second swivel mechanism, the screen rotatable in a first rotational direction about a first axis of rotation defined by the first swivel mechanism, the screen rotatable in a second rotational direction about a second axis of rotation defined by the second swivel mechanism, the second axis of rotation being perpendicular to the first axis of rotation;

the first swivel mechanism including a first swivel lock or swiveling force adjustment mechanism that is actuatable to adjust an amount of force needed to permit rotation of the screen in the first rotational direction, the first swivel lock or swiveling force adjustment mechanism including a set screw extending between inner and outer tubular elements positioned adjacent the first end of the telescoping member; and the second swivel mechanism including a lock or force adjustment mechanism that is actuatable to adjust an amount of force needed to permit rotation of the screen in the second rotational direction, the lock or force adjustment mechanism of the second swivel mechanism including a rotatable element that is rotatable to adjust the amount of the force needed for rotation of the screen in the second rotational direction.

2. The light blocking apparatus of claim 1, wherein the first axis of rotation of the first swivel mechanism is parallel to a length of the telescoping member and the second axis of rotation of the second swivel mechanism is transverse or perpendicular to the length of the telescoping member.

3. The light blocking apparatus of claim 2, wherein the light blocking device attachment mechanism is configured so that the light blocking device is slideable along a structure when attached to the structure.

4. The light blocking apparatus of claim 3, wherein the light blocking device attachment mechanism includes a body having a first jaw and a second jaw spaced apart from the first jaw to define a mouth for receiving at least a portion of the structure; and wherein the light blocking device attachment mechanism also includes a ball joint or an axle about which the second end the telescoping member is rotatable such that the intermediate portion is rotatable relative to the light blocking device attachment mechanism.

5. The light blocking apparatus of claim 1, wherein the light blocking device attachment mechanism is configured so that the light blocking device is slideable along a structure when attached to the structure.

6. The light blocking apparatus of claim 5, wherein the light blocking device attachment mechanism includes a body having a first jaw and a second jaw spaced apart from the first jaw to define a mouth for receiving at least a portion of the structure.

7. The light blocking apparatus of claim 6, wherein the first jaw is moveable relative to the second jaw to adjust a size of the mouth.

8. The light blocking apparatus of claim 6, wherein the light blocking device attachment mechanism includes a ball joint or an axle about which the second end the telescoping member is rotatable such that the intermediate portion is rotatable relative to the light blocking device attachment mechanism.

9. The light blocking apparatus of claim 1, wherein the light blocking device attachment mechanism includes a ball joint or an axle about which the second end the telescoping member is rotatable such that the intermediate portion is rotatable relative to the light blocking device attachment mechanism.

10. The light blocking apparatus of claim 1, wherein the light blocking device attachment mechanism also includes a ball joint about which the second end the telescoping member is rotatable such that the intermediate portion is rotatable relative to the light blocking device attachment mechanism.

11. The light blocking apparatus of claim 10, wherein the light blocking device attachment mechanism is configured so that the light blocking device is slideable along a structure when attached to the structure.

* * * * *